US006125780A

United States Patent [19]

Sweetman et al.

[11] Patent Number: 6,125,780

[45] Date of Patent: Oct. 3, 2000

[54] FLOATING BARGE-PLATFORM AND METHOD OF ASSEMBLY

[75] Inventors: John A. Sweetman, Farmers Branch; George Z. Gu, Irving; David L. Garrett, Dallas, all of Tex.

[73] Assignee: Mobil Oil Corporation, Fairfax, Va.

[21] Appl. No.: 08/843,426

[22] Filed: Apr. 15, 1997

[51] Int. Cl.[7] ..... B63B 35/44

[52] U.S. Cl. ..... 114/264; 114/77 R; 114/266

[58] Field of Search ..... 114/263, 264, 114/266, 77 R, 126, 265

[56] References Cited

U.S. PATENT DOCUMENTS

| | | | |
|---|---|---|---|
| H611 | 4/1989 | Peace | 114/264 |
| 2,924,191 | 2/1960 | Blumquist et al. | 114/266 |
| 3,089,452 | 5/1963 | Pedersen | 114/126 |
| 3,224,401 | 12/1965 | Kobus | 114/265 |
| 3,500,783 | 3/1970 | Johnson, Jr. et al. | 114/0.5 |
| 3,521,588 | 7/1970 | Atlas | 114/263 |
| 3,766,874 | 10/1973 | Helm et al. | 114/0.5 D |
| 3,774,562 | 11/1973 | Dean, III | 114/0.5 D |
| 3,913,336 | 10/1975 | Figari | 61/46.5 |
| 3,922,986 | 12/1975 | Minamizaki et al. | 114/74 A |
| 3,942,459 | 3/1976 | Sato | 114/74 R |
| 3,951,089 | 4/1976 | Corlett | 114/125 |
| 3,965,513 | 6/1976 | Horiuchi | 9/25 |
| 3,970,024 | 7/1976 | Fisher | 114/266 |
| 3,983,830 | 10/1976 | Morgan | 114/77 R |
| 4,023,514 | 5/1977 | Finsterwalder et al. | 114/256 |
| 4,080,916 | 3/1978 | Nastasic et al. | 114/65 R |
| 4,145,770 | 3/1979 | Zaris | 114/264 |
| 4,217,848 | 8/1980 | Meyer-Haake | 114/264 |
| 4,359,164 | 11/1982 | Triplett | 114/264 |
| 4,385,578 | 5/1983 | Grace | 114/77 A |
| 4,411,212 | 10/1983 | Bergman | 114/125 |
| 4,458,619 | 7/1984 | Bergman | 114/125 |
| 4,498,412 | 2/1985 | Liden | 114/264 |
| 4,889,447 | 12/1989 | Strange | 405/60 |
| 4,961,394 | 10/1990 | Fornoff et al. | 114/266 |
| 4,982,681 | 1/1991 | Jarlan | 114/125 |
| 5,010,835 | 4/1991 | Kunitake et al. | 114/126 |
| 5,012,756 | 5/1991 | Kristensen | 114/265 |
| 5,297,899 | 3/1994 | Culley | 114/266 |
| 5,529,013 | 6/1996 | Eva, III | 114/263 |
| 5,833,397 | 11/1998 | Horton, III | 114/264 |

*Primary Examiner*—Sherman Basinger

[57] ABSTRACT

A stable floating barge-platform for offshore operations and a method for assembling same. The barge-platform is assembled from a plurality of substantially identical, buoyant modules, all of which have substantially the same outer configuration. The buoyant modules are constructed onshore and transported to an offshore location where they are positioned and connected together to form the platform. When connected, an opening will be present through the center of the platform. This opening reduces the bottom area of the platform and accordingly substantially reduces the wave forces on the platform.

14 Claims, 2 Drawing Sheets

FLOATING BARGE-PLATFORM AND METHOD OF ASSEMBLY

DESCRIPTION

1. Technical Field

The present invention relates to a floating platform having an opening through the center thereof and a method for assembling same and in one of its aspect relates to a stable floating, barge-like platform of the type used in the production and/or processing of hydrocarbons wherein the platform has a central opening therethrough to alleviate wave forces on said platform; said platform being assembled on site from a plurality of uniform modules which, in turn, are constructed onshore.

2. Background of the Invention

Floating barge-like platforms have long been used in the offshore oil industry. That is, floating platforms have been used for drilling subsea wells, for processing and/or storing the fluids produced from subsea wells, as loading and offloading terminals for such fluids; etc. Typically, these barge-platforms are built onshore in commercially-existing dry docks or other shipbuilding facilities and then towed to their respective offshore sites.

Unfortunately, most existing, commercially-available facilities are limited as to size platform that can be built at that facility without very expensive modifications being made to the facility. Unfortunately, even if it is practical to make such modifications, the modified facility may only be required to build a "one-of-a-kind" platform and the modifications may be of little, if any, further use in building future platforms. Accordingly, it would be highly beneficial to be able to build substantially larger platforms in already existing facilities without requiring any substantial modifications to those facilities.

Also, most floating barge-platforms of this type have a large, bottom surface which is exposed to wave action. It is known that this wave action can exert substantial forces against the bottom of the platform which, in turn, can result in severe heave, pitch, and/or roll of the platform. Such motions can be highly detrimental to any delicate equipment, i.e. gas processing equipment, electrical generating equipment, etc., which may be mounted on the deck of the platform and to the safety of any crew aboard.

Further, exaggerated movement of the platform can severely damage any marine risers or the like which may be connected to the platform; i.e. risers for transferring fluids to or from the marine bottom to the platform; loading and/or unloading lines, etc. Still further, this undesirable movement of the platform can severely hinder the loading of fluids onto or off of the platform from or onto other ships or barges. Accordingly, it is desirable to dampen the effects of such wave action against the bottom of the barge-platform in order to provide a stable platform from which operations can be safely carried out.

SUMMARY OF THE INVENTION

The present invention provides a floating barge-platform for offshore operations which is stable and which is capable of being constructed in existing onshore facilities which otherwise would only be capable of building smaller vessels. The barge-platform is essentially a relatively large vessel which has an opening through the center thereof for dampening the wave forces on the bottom of the platform. This center opening is similar to a "moonpool" in known offshore drilling vessels. However, traditional moonpools are normally as small as possible since they only serve to provide an access for the drill string and related equipment through the deck of the vessel.

In the present invention, the center opening through the platform is sized to substantially reduce the bottom area of the barge-platform which is exposed to the wave action in the body of water in which the barge-platform is moored. This reduction in the effective bottom area of the barge-platform (a) increases the draft of the platform and (b) reduces the area on which the wave forces act, thereby substantially reducing the pitch, heave, and/or roll normally caused by this wave action. In order to significantly reduce these undesirable motions, the cross-sectional area of the opening will need to be equal to at least 6% of the total bottom area of the barge. This is a substantially larger opening relative to the bottom area of the platform than is a "moonpool" opening relative to the bottom area of a drilling vessel.

The present barge-platform is assembled from a plurality of substantially identical, buoyant modules, all of which have substantially the same outer configuration. This allows the modules to be effectively "cookie-cut" in a standard slip of an onshore ship building facility with little or no substantial modifications being required, which, by itself, results in substantial savings. Also, by assembling the platform from uniform modules, a final barge-platform can be much larger than could otherwise be produced using the same, existing onshore facility.

Each of the buoyant modules may be constructed using the same materials and building techniques as those used in building sea-going vessels with each having substantially the same outer configuration as the others. The modules are constructed onshore and transported to a desired offshore location where they are maneuvered and positioned in relation to each other to define the desired outer periphery of the barge-platform. For example, four substantially rectangular modules can be positioned to form a substantially square barge-platform. When the modules are properly positioned, there will be an opening through the center of the assembled modules.

Abutting modules are connected together to form a stable barge-platform which, in turn, is designed to carry out a particular offshore operation; e.g. processing produced fluids, loading and offloading fluids, generating electrical power, etc. The tops of the modules may serve as a deck on which equipment is mounted to carry out a particular offshore operation or a separate deck can be laid across the tops of the modules, if desired or needed. If such a separate deck covers the center opening, means should be provided to vent the opening to the atmosphere.

Baffle means, e.g. plates or fins, may be affixed around the outer periphery of the barge-platform to dampen wave action against said barge-platform, thereby further reducing undesirable movements of the barge-platform. Also, additional baffle means may be affixed within the center opening for dampening wave action within said opening, still further adding to the stability of the assembled barge-platform.

BRIEF DESCRIPTION OF THE DRAWINGS

The actual construction, operation, and apparent advantages of the present invention will be better understood by referring to the drawings, not necessarily to scale, in which like numerals identify like parts and in which.

BEST KNOWN MODE FOR CARRYING OUT THE INVENTION

Figure 1:
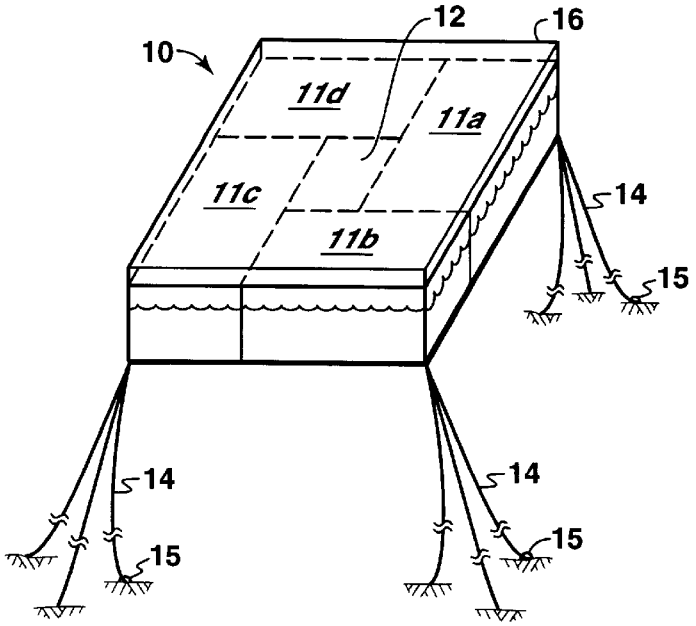
FIG. 1 is a perspective view of a barge-platform assembled in accordance with the present invention as it would appear in an operable position within a body of water.
Figure 2:
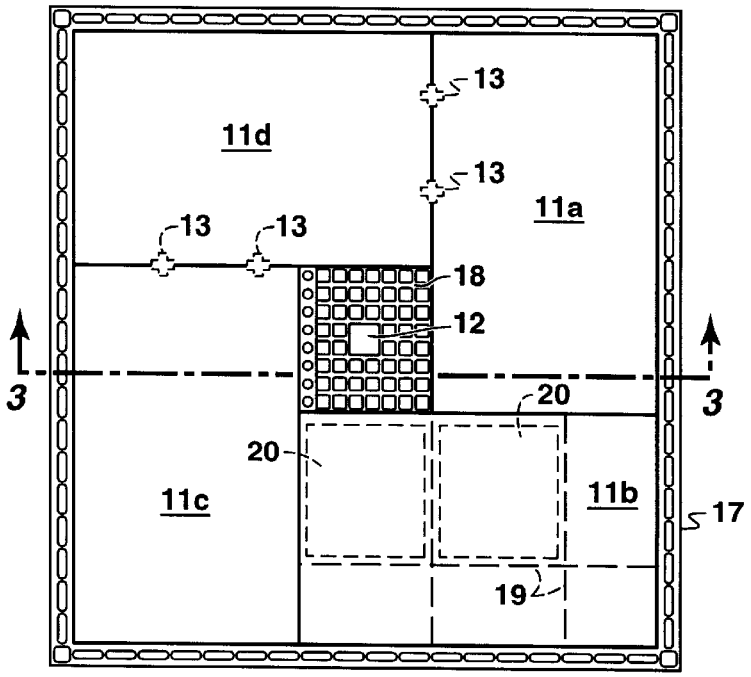
FIG. 2 is a top view of the barge-platform seen in FIG. 1.
Figure 3:
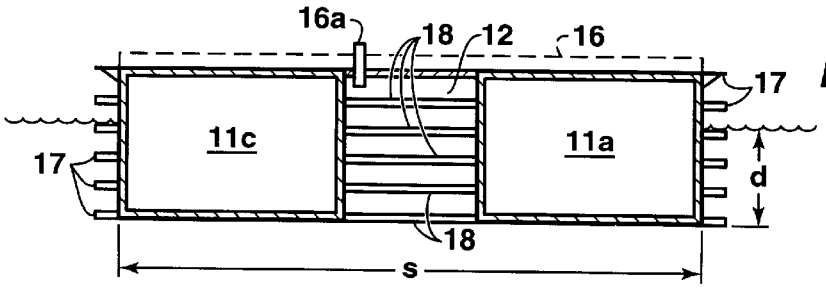
FIG. 3 is a sectional view taken along line 3—3 of FIG. 2.

Referring more particularly to the drawings, FIGS. 1–3 illustrates a floating, barge-like platform 10 which has been assembled in accordance with the present invention. The barge-platform is basically a buoyant vessel having an opening through the center thereof for a purpose to be discussed below.

Platform 10, as illustrated, is a vessel which is formed of a plurality (i.e. four) substantially identical, buoyant modules 11*a*, 11*b*, 11*c*, and 11*d*. Each module is a substantially rectangularly-shaped, buoyant hull which, in turn, is preferably constructed in a slip of an onshore, commercially-available dry dock or ship building facility. The hull is preferably built with standard marine materials (e.g. steel plate) and techniques commonly used in the building of sea-going vessels. In some instances, the modules can be constructed from poured, reinforced concrete, as will be understood in this art. Each module 11 may range in size up to a maximum which, in turn, will normally be determined by the particular capabilities of the builder without requiring substantial enlargement modifications to the facility.

Four similar buoyant modules 11 are completed onshore and are towed or otherwise transported to a desired offshore location. At the offshore site, the modules are maneuvered until they are aligned substantially as shown in FIGS. 1–3. It will he noted that when all of modules 11 are in their desired positions, they will define an opening 12 at and through the center of the assembled modules. Abutting modules are then connected together to form barge-platform 10 having a substantially square periphery with opening 12 through the center thereof. The modules can be connected together by any appropriate means; (a) welding or the like, (b) by large holt-like fasteners (dotted lines 13, only two sets shown), or (c) combinations thereof, or (d) any other connect in structures.

After modules 11 are assembled, platform 10 may then be moored on site by any appropriate means, e.g. catenary mooring lines 14 attached between each of the corners of platform 10 and respective piles or anchors 15 on the marine bottom. If not already in place, a separate deck 16 (FIGS. 1 and 3) may be assembled onto the platform by securing steel plating or the like across the tops the modules by any appropriate means, e.g. welding, bolts, etc.

This plating may overlap between modules, if desired, to cover any gaps between modules and to further strengthen the connection between the modules. If the central opening 12 is to be covered by deck 16, ventilation means (e.g. pipe 16*a*, FIG. 3) should be provided to allow central opening 12 to be vented to the atmosphere. In some instances, a separate deck may not be desired or needed wherein the top plates of the modules, themselves, will form the deck of the platform.

In any event, deck 16 will support the equipment (not shown for the sake of clarity) required to carry out the particular operation to be performed on the platform 10. That is, if the platform is to be used to process hydrocarbon gases to produce liquid natural gas (LNG), appropriate cooling and compressing equipment would be mounted on deck 16. If platform 10 is to be used as an offloading terminal for LNG, then regassification equipment would be mounted on deck 16, and so on.

Preferably, baffles (e.g. plates or fins 17, FIGS. 2–3) are secured to the outer periphery of barge-platform 10 to dampen the action of the waves about the sides of the platform. Preferably, a portion of this baffling is fixed to each module during construction of the modules on land and is then aligned and joined as the modules are assembled together on site. Also, baffle grid plates 18 or the like may be affixed within central opening 12 to dampen any wave action within the opening. These grids can be affixed within opening 12 in any appropriate manner, e.g. a part of each grid (e.g. one-fourth) can be mounted on each module 11 as it is being constructed so that when the four modules are properly positioned, the respective parts can be connected to each other to form the grid plates 18 within opening 12.

The outer configuration of each module 11 is basically identical to that of all of the other modules 11. This permits the basic structure of each module to be "cookie-cut", one after the other, in the same slip of the building facility without having to modify the slip. The interior of each module may also be identical or may differ, depending on the ultimate use of barge-platform 10.

For example, where the modules are used to form a barge-platform for processing hydrocarbon gas to produce liquid natural gas (LNG), the interiors of the modules might require different configurations. As illustrated in FIG. 2, the interior of some of the modules might look like that shown in the dotted lines; i.e. bulkheads 19 separate the interior of module 11*b* into compartments; some of which have LNG storage tanks 20 positioned therein while other compartments (unnumbered) may be used for storage of fuel, water, coolant, etc. Likewise, the interior of other modules 11 may have completely different configurations depending on what is needed for the particular operation being carried out on the platform. However, the build-out of the interior of a particular module will not require modification of the slip within the building facility as would the changing of the outer periphery of the module.

Again, it is pointed out that once the modules 11 are assembled to form barge-platform 10, opening 12 is inherently formed in the center of the platform. The purpose of opening 12 is to improve the hydrodynamics of the platform when moored on site. By effectively "removing" or eliminating the central portion of the platform, the area on the bottom of the barge-platform is decreased thereby causing the draft of the vessel to increase which, in turn, decreases the amount of force which is exerted on the bottom of platform by the wave action.

Removing the center portion of the platform does not substantially affect the moment of inertia of the water-plane and does not substantially affect roll or pitch stiffness of the platform. The improved dampening effect provided by the central opening 12 does however, make the platform a more stable platform for supporting delicate processing equipment and the like. Again, center opening 12 alleviates unwanted motion of barge-platform 10 in two ways: (a) it increases the draft of the platform and (b) it reduces the actual bottom area on which the waves act.

In the present invention, the motion reduction efficiency of barge-platform 10 is dependent on the size of opening 12 (i.e. area) relative to the overall size of the platform (i.e. total bottom area). The larger opening 12 in relation to the fixed size of a platform, the more efficient the motion reduction. While it is desirable to make the cross-sectional area of opening 12 as large as possible in relation to the overall cross-sectional area of the barge-platform 10, its size is limited by practical considerations; i.e. required usable space within the platform and the height and draft of the assembled platform.

It has been estimated by using known hydrodynamic relationships (e.g. Froude-Krylov method) that the area of opening 12 needs to be equal to at least 6% of the total bottom area in order to produce a significant reduction in wave action on the barge-platform. This estimation assumes that the wave field is not disturbed by the barge-platform and that the pressure on the bottom of the barge is the same as if the barge were not there. This is most effective for mid-range wave periods and less effective for long wave periods. In reality, most of the wave energy is carried by the mid-range period waves and only a little is carried by the long waves. Short waves normally cannot penetrate deep enough and do not have long enough lengths to produce any significant exciting force and/or moment on the barge bottom.

Figure 5:
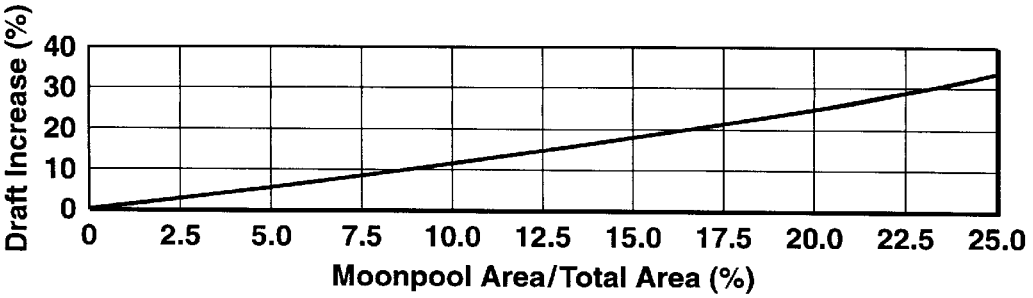
FIG. 5 is a graph illustrating how the size of the opening through the barge-platform effects the draft of the barge-platform.

FIG. 5 is a graph showing how the size of opening 12 will increase the draft "d" of barge-platform 10. For example, an opening 12 having a cross-sectional area which is 6% of the total cross-sectional area of the bottom of barge 10 will increase the draft of the barge by approximately 6%. It car he seen that rate of draft increase in relation to the increase in the size of opening 12 is nonlinear and increases more rapidly as the size of opening 12 increases. FIG. 5 is based on calculations assuming a substantially square barge-platform 10 having sides "s" (FIG. 3) of 165 meters long and an original draft "d" of 23.5 meters.

Figure 4A:
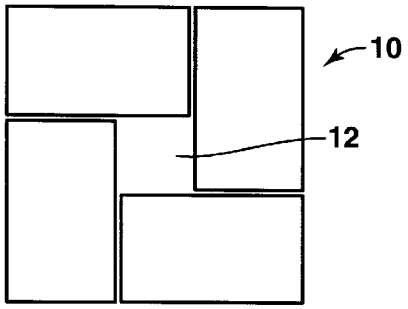
FIGS. 4*a*–4*f* are representative top views of different embodiments of the present invention wherein the respective barge-platforms have different shaped peripheries.
Figure 4B:
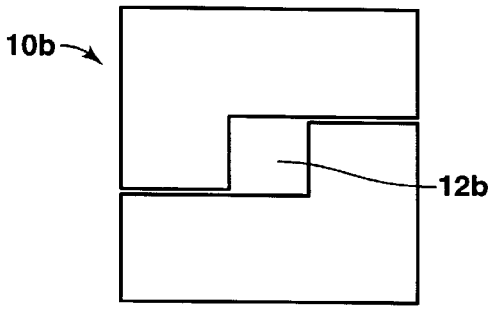
Figure 4C:
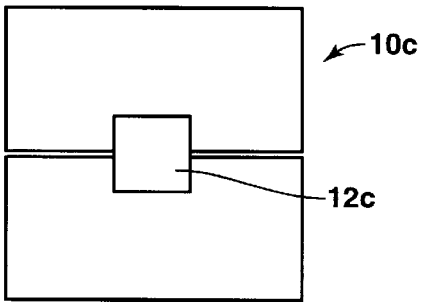

While the barge-platform has been described as having a square periphery when assembled with a square opening in the center thereof, other configurations can be employed in assembling barge-platforms in accordance with the present invention. Also, while square platform 10 (FIG. 4*a*) is shown as being assembled from four substantially rectangular modules, other square platforms may only require two symmetrical L-shaped modules (FIG. 4*b*) or two symmetrical C-shaped modules FIG. 4*c*).

Figure 4D:
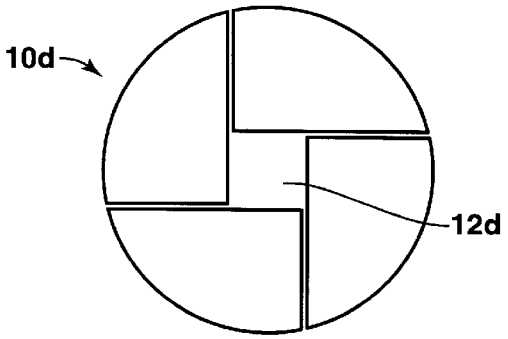
Figure 4E:
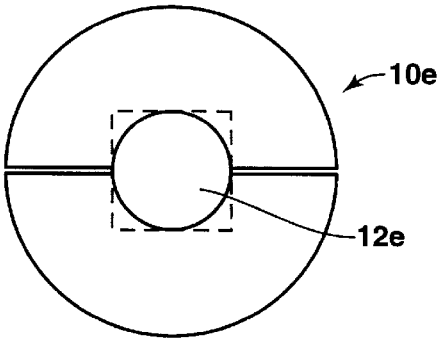
Figure 4F:
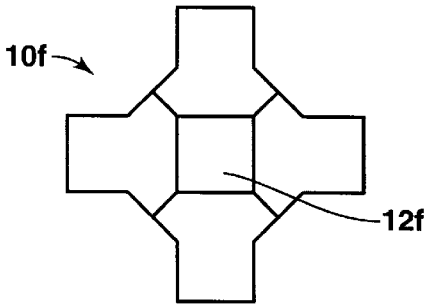

Further, the outer periphery may be other than a square, e.g. a circle assembled with either four substantially identical modules (FIG. 4*d*) or assembled with two indentical substantially semi-circular modules (FIG. 4*e*). Likewise, opening 12 may have other peripheries; i.e. circular as shown in FIG. 4*e*. The modules may have even more exotic peripheries when assembled, e.g. a modified cross (FIG. 4*f*) or the like, if such a platform might be required for a particular application. However, in all of these barge-platforms, it can he seen that each uses respective identical modules which when assembled, all define an opening 12–12*f*, respectively, through the center thereof for the same purpose as set forth above.

What is claimed is:

1. An offshore barge-platform for use in producing and/or processing of hydrocarbons comprising:

a buoyant vessel having an outer periphery and having an opening through the center thereof, said opening having a cross-sectional area equal to at least 6% of the total cross-sectional area of said barge-platform to thereby increase the draft of said vessel and decrease the wave force applied to the bottom of said vessel;

a plurality of grid plates spaced vertically and affixed within said opening through said barge-platform for dampening wave action within said opening;

a deck on said vessel adapted to support equipment used in said producing and/or processing said hydrocarbons, said deck covering said opening;

means through said deck for ventilating said opening to the atmosphere; and at least one tank positioned within said buoyant vessel for storing said hydrocarbons.

2. The barge-platform of claim 1 including:

a baffle means affixed around said outer periphery of said barge-platform for dampening wave action against said barge-platform.

3. The offshore barge-platform of claim 1 wherein said buoyant vessel comprises:

a plurality of buoyant modules, each of said modules having a substantially identical, outer configuration and being assembled and connected together so that said opening exists through the center of the connected modules and wherein said at least one tank is positioned within one of said plurality of buoyant modules.

4. The barge-platform of claim 3 herein said modules when connected form a barge-platform having a substantially square outer periphery.

5. The barge-platform of claim 3 wherein said modules when connected form a barge-platform having a substantially circular periphery.

6. The barge-platform of claim 3 wherein said modules when connected form a barge-platform having a substantially modified cross periphery.

7. The barge-platform of claim 3 wherein said deck is formed of said tops of said connected modules, themselves.

8. The barge-platform of claim 3 wherein said deck is formed of plating affixed to said tops of said connected modules.

9. An offshore barge-platform for use in a body of water for producing and/or processing of hydrocarbons comprising:

a buoyant hull having an outer periphery and having an opening through the center thereof, said opening having a cross-sectional area equal to at least 6% of the total cross-sectional area of said barge-platform. to thereby increase the draft of said vessel and decrease the wave force applied to the bottom of said vessel; said outer periphery of said hull being formed of substantially solid side walls all of which extend from the top of said hull to the bottom of said hull wherein the upper portion of each wall will extend above the surface of said body of water when said buoyant hull is in an operable position within said body of water whereby the entire top of said buoyant hull will lie completely above said body of water;

baffle means affixed within said opening through said barge-platform and extending substantially across said opening for dampening wave action within said opening;

a deck on said top of said hull adapted to support equipment used in said producing and/or processing said hydrocarbons, and at least one tank positioned within said buoyant hull for storing said hydrocarbons.

10. The barge-platform of claim 9 wherein said deck is positioned on said top of said hull without extending across said opening.

11. The barge-platform of claim 10 wherein said buoyant hull comprises:

a plurality of buoyant modules, each of said modules having a substantially identical, outer configuration and being assembled and connected together so that said opening exists through the center of the connected modules, and wherein said at least one tank is positioned within one of said plurality of buoyant modules.

12. The barge-platform of claim 9 including:

a baffle means affixed around said outer periphery of said hull for dampening wave action against said barge-platform.

13. The barge-platform of claim 9 wherein said side walls forming said hull are comprised of steel plates.

14. The barge-platform of claim 9 wherein said side walls forming said hull are comprised of concrete.

* * * * *